US009926744B2

(12) United States Patent
Lane

(10) Patent No.: US 9,926,744 B2
(45) **Date of Patent: *Mar. 27, 2018**

(54) DEVICES AND METHODS FOR HORIZONTAL DIRECTIONAL DRILLING WITH A BORING TOOL LIBRARY

(71) Applicant: Vermeer Corporation, Pella, IA (US)

(72) Inventor: Philip R. Lane, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 220 days.

This patent is subject to a terminal disclaimer.

(21) Appl. No.: 14/462,875

(22) Filed: Aug. 19, 2014

(65) Prior Publication Data

US 2014/0353034 A1 Dec. 4, 2014

Related U.S. Application Data

(63) Continuation of application No. 13/960,603, filed on Aug. 6, 2013, now Pat. No. 8,807,241, which is a (Continued)

(51) Int. Cl.

| | |
|---|---|
| ***E21B 44/00*** | (2006.01) |
| ***E21B 7/04*** | (2006.01) |
| ***E21B 44/02*** | (2006.01) |

(52) U.S. Cl.

CPC ..... *E21B 7/046* (2013.01); *E21B 44/00* (2013.01); *E21B 44/02* (2013.01)

(58) Field of Classification Search

USPC .... 175/24, 51, 202, 203, 19, 26, 27, 40, 60, 175/53

See application file for complete search history.

(56) References Cited

U.S. PATENT DOCUMENTS 5,699,261 A 12/1997 Muona
5,746,278 A 5/1998 Bischel
(Continued)

FOREIGN PATENT DOCUMENTS

WO WO 00/42287 7/2000
WO WO 2009075667 A2 * 6/2009 ..... E21B 44/00

OTHER PUBLICATIONS

The International Search Report and Written Opinion from counterpart PCT Application No. PCT/US2009/034402 dated Sep. 8, 2009.

(Continued)

*Primary Examiner* — D. Andrews
*Assistant Examiner* — Ronald R Runyan
(74) *Attorney, Agent, or Firm* — Hollingsworth Davis, LLC

(57) ABSTRACT

Various embodiments are directed to a method and apparatus for horizontal directional drilling with a tool library. Various methods include storing a plurality of operational tool profiles in memory, the operational tool profiles of the plurality respectively associated with a plurality of boring tools attachable to a drill string for HHD and each of the operational tool profiles of the plurality including operating parameters for the boring tool of the plurality with which the operational profile is associated, and selectively displaying the operational tool profiles on a display screen based on user input.

18 Claims, 6 Drawing Sheets

Related U.S. Application Data continuation of application No. 12/388,321, filed on Feb. 18, 2009, now Pat. No. 8,499,855.

(60) Provisional application No. 61/066,002, filed on Feb. 18, 2008.

(56) References Cited

U.S. PATENT DOCUMENTS

| | | | | |
|---|---|---|---|---|
| 5,844,133 | A | 12/1998 | Goto et al. | |
| 6,186,248 | B1 | 2/2001 | Silay et al. | |
| 6,308,787 | B1 | 10/2001 | Alft | |
| 6,651,755 | B1 | 11/2003 | Kelpe | |
| 6,749,029 | B2 | 6/2004 | Alft et al. | |
| 8,499,855 | B2 | 8/2013 | Lane | |
| 8,807,241 | B2 | 8/2014 | Lane | |
| 2003/0063013 | A1 | 4/2003 | Jin et al. | |
| 2003/0205409 | A1 | 11/2003 | Koch et al. | |
| 2006/0180356 | A1* | 8/2006 | Durairajan | E21B 10/42 175/431 |
| 2007/0021857 | A1 | 1/2007 | Huang | |
| 2007/0185696 | A1 | 8/2007 | Moran et al. | |
| 2007/0240903 | A1 | 10/2007 | Alft et al. | |
| 2010/0030527 | A1 | 2/2010 | Prasad et al. | |

OTHER PUBLICATIONS

File History for U.S. Appl. No. 12/388,321.
File History for U.S. Appl. No. 13/960,603.

* cited by examiner

200

201

300

301

DEVICES AND METHODS FOR HORIZONTAL DIRECTIONAL DRILLING WITH A BORING TOOL LIBRARY

RELATED APPLICATIONS

This application is a continuation of U.S. Ser. No. 13/960,603, filed Aug. 6, 2013, which is a continuation of U.S. Ser. No. 12/388,321, filed Feb. 18, 2009, now U.S. Pat. No. 8,499,855, which claims the benefit of Provisional Patent Application Ser. No. 61/066,002, filed on Feb. 18, 2008, to which Applicant claims priority under 35 U.S.C. § 119(e), and which is incorporated herein by reference in its entirety.

FIELD OF THE INVENTION

The present invention relates generally to the field of underground boring and, more particularly, to a system and method for horizontal directional drilling with a boring tool library.

BACKGROUND OF THE INVENTION

Utility lines for water, electricity, gas, telephone, and cable television are often run underground. In many situations, the underground utilities can be buried in a trench which is then back-filled. Although useful in areas of new construction, the burial of utilities in a trench has certain disadvantages. In areas supporting existing construction, a trench can cause serious disturbance to structures or roadways. Further, there is a high probability that digging a trench may damage previously buried utilities, and that structures or roadways disturbed by digging the trench are rarely restored to their original condition. Also, an open trench poses a danger of injury to workers and passersby.

The general technique of boring a horizontal underground hole has recently been developed in order to overcome the disadvantages described above, as well as others unaddressed when employing conventional trenching techniques. In accordance with such a general horizontal boring technique, also known as horizontal directional drilling (HDD) or trenchless underground boring, a boring system is situated on the ground surface and drills a hole into the ground at an oblique angle with respect to the ground surface. A drilling fluid is typically flowed through the drill string, over the boring tool, and back up the borehole in order to remove cuttings and dirt. After the boring tool reaches a desired depth, the tool is then directed along a substantially horizontal path to create a horizontal borehole. After the desired length of borehole has been obtained, the tool is then directed upwards to break through to the earth's surface. A reamer is then attached to the drill string which is pulled back through the borehole, thus reaming out the borehole to a larger diameter. It is common to attach a utility line or other conduit to the reaming tool so that it is dragged through the borehole along with the reamer.

Another technique associated with horizontal directional drilling, often referred to as push reaming, involves attaching a reamer to the drill string at the entry side of a borehole after the boring tool has exited at the exit side of the borehole. The reamer is then pushed through the borehole while the drill rods being advanced out of the exit side of the borehole are individually disconnected at the exit location of the borehole. A push reaming technique is sometimes used because it advantageously provides for the recycling of the drilling fluid. The level of direct operator interaction with the drill string, such as is required to disconnect drill rods at the exit location of the borehole, is much greater than that associated with traditional horizontal directional drilling techniques.

For boring, the drill is fitted with different tools (also referred interchangeably herein as bits, cutting tool, drill attachments, boring tools) depending on the underground conditions and the particular type of hole to be drilled. The cutting tools have different properties and require that the machine be operated differently. For efficient and effective drilling the machine parameters are adjusted in part based on the specific cutting tool attached to the drill string. For example, the maximum thrust applied may be different from one cutting tool to the next. Traditionally, operators need to be trained on each of the tools so that they can set the appropriate control parameters base on the selected tool. Since a number of control parameters correspond to each tool type, the operators often need to rely on reference books that they carry with them to the job site. In addition, operators typically need to be trained to collect key data from the job site manually. For example, if multiple holes need to be drilled at a single job site over an extended period of time, it may be desirable to track the performance and machine feedback during the drilling of the first holes so that the drilling of the later holes can be optimized. The present disclosure provides an improved horizontal directional drilling machine and related methods that address some of these issues.

SUMMARY OF THE INVENTION

The present disclosure provides a machine and method wherein the machine parameters can be automatically set based on the selection of a particular cutting tool. The machine is therefore easier to operate and facilitates more efficient and effective drilling.

The present disclosure provides a machine and method that track and record the machine feedback and other data at each job site. Data tracking is used, for example, to help the operator better understand how the tools are performing and make better tool selection based on the actual data.

Various system embodiments of this disclosure concern a horizontal directional drilling (HDD) system having a tool library, the HDD system comprising a plurality of tools configured to attach to a distal end of a drill string, each of the tools of the plurality configured for cutting soil in HDD, a user interface having a display screen and a user input configured to output a user input signal, and, a controller coupled to the user interface and the user input, the controller configured to receive the user input signal, store a plurality of operational tool profiles respectively associated with the plurality of tools, and selectively display one or more of the operational tool profiles on the display screen based on the user input signal, wherein each operational profile of the plurality contains operating parameters for the tool of the plurality with which the operational profile is associated.

In some of these system embodiments, the operating parameters of each operational tool profile include operational boring parameter limits for the tool of the plurality with which the operational profile is associated. In some of these system embodiments, the operational boring parameter limits comprise one or more of a thrust limit, a rotational limit, a pressure limit, and a mud delivery limit. In some of these system embodiments, the operating parameters of each operational tool profile include information regarding one or more autodrill modes that the tool of the plurality with which the operational profile is associated is suited to execute.

Some of these system embodiments may further include a thrust pump configured to linearly advance the drill string based on a thrust control signal, and a rotation pump configured to rotate the drill string based on a rotation control signal, wherein the operating parameters of each operational tool profile include information regarding one or more automated drill modes that the tool of the plurality with which the operational profile is associated is suited to execute, and the controller is configured to automatically modulate the thrust control signal and the rotation control signal to operate the HDD system in accordance with the one or more automated drill modes based on selection, via the user input signal, of the operational profile associated with the one or more automated drill modes.

In some of these system embodiments, the operating parameters of each operational tool profile include a graphic depiction of the tool of the plurality with which the operational profile is associated and the controller is configured to display the graphic on the display screen based on user selection of the operational tool profile, the user selection based on the input control signal.

In some of these system embodiments, the controller is further configured to organize the plurality of operational tool profiles into multiple customized directories, each customized directory of the multiple customized directories is user selectable based on the user input signal, and only those operational tool profiles organized into one or more of the customized directories that are selected are searchable while one or more of the customized directories are selected for searching based on the input control signal. In some of these system embodiments, the multiple customized directories correspond to a different job site and each of the operational tool profiles organized into each customized directory corresponds to one of a plurality of boring tools available at the respective job site.

In some of these system embodiments, the controller is further configured to save boring data collected during boring operations, the boring data being indexed to the operational profile of the tool of the plurality attached to the drill string during boring operations as indicated by selection of the operational profile during boring operations, selection of the operational profile based on the input control signal, and wherein the controller is further configured to display the boring data when the operational profile to which the boring data is indexed is displayed on the display screen.

In some of these system embodiments, at least one of the operational tool profiles of the plurality include a default setting and a customized setting, each of the default setting and the customized setting including information regarding operation of the boring tool with which the at least one operational profile is associated.

Various embodiments of this disclosure concern a method of organizing operational control parameters in horizontal directional drilling (HDD), the method comprising storing a plurality of operational tool profiles in memory, the operational tool profiles of the plurality respectively associated with a plurality of tools attachable to a drill string and configured for HHD, each of the operational tool profiles of the plurality including operating parameters for the tool of the plurality with which the operational profile is associated, and selectively displaying the operational tool profiles on a display screen based on a user input.

In some of these method embodiments, the operating parameters of each operational tool profile include operational boring parameter limits for the tool of the plurality with which the operational profile is associated. In some of these system embodiments, the operational boring parameter limits comprise one or more of a thrust limit, a rotational limit, a pressure limit, and a mud delivery limit. In some of these system embodiments, the operating parameters of each operational tool profile include information regarding one or more autodrill modes that the boring tool of the plurality with which the operational profile is associated is suited to execute.

Some of these methods may further include selecting an operational profile of the plurality of operational profiles based on the user input, the selected operational profile including control instructions for an automated drill mode, and automatically controlling an output of a thrust pump that linearly advances the drill string and an output of a rotation pump that rotates the drill string using a control circuit in accordance with the automated drill mode of the selected operational tool profile. Some of these methods may further include organizing the plurality of operational tool profiles into multiple customized directories, selecting one or more of the multiple customized directories based on user input, and searching amongst only those operational tool profiles that are organized into one or more of the customized directories that are selected.

In some of these method embodiments, the multiple customized directories respectively correspond to a plurality of job sites and the operational tool profiles organized into the customized directories respectively correspond to boring tools available at the respective job sites.

Some of these method embodiments may further include boring at least a portion of a bore hole using a boring tool associated with a selected operational profile of the plurality of operational profiles, collecting boring data while boring the portion of the bore hole, saving the boring data in memory, the boring data indexed to the operational profile of the selected operational profile, and displaying the boring data on the display screen when the selected operational profile is displayed on the display screen.

Various embodiments of this disclosure concern a horizontal directional drilling (HDD) system having a tool library, the system comprising means for storing a plurality of operational tool profiles in memory, the operational tool profiles of the plurality respectively associated with a plurality of tools attachable to a drill string and configured for HHD, each of the operational tool profiles of the plurality including operating parameters for the tool of the plurality with which the operational profile is associated, and means for selectively displaying the operational tool profiles on a display screen based on a user input.

Some of these system embodiments may further include means for organizing the plurality of operational tool profiles into multiple customized directories, means for selecting one or more of the multiple customized directories based on user input, and means for searching amongst only those operational tool profiles that are organized into the one or more customized directories that are selected.

The above summary of the present invention is not intended to describe each embodiment or every implementation of the present invention. Advantages and attainments, together with a more complete understanding of the invention, will become apparent and appreciated by referring to the following detailed description and claims taken in conjunction with the accompanying drawings.

Figure 1:
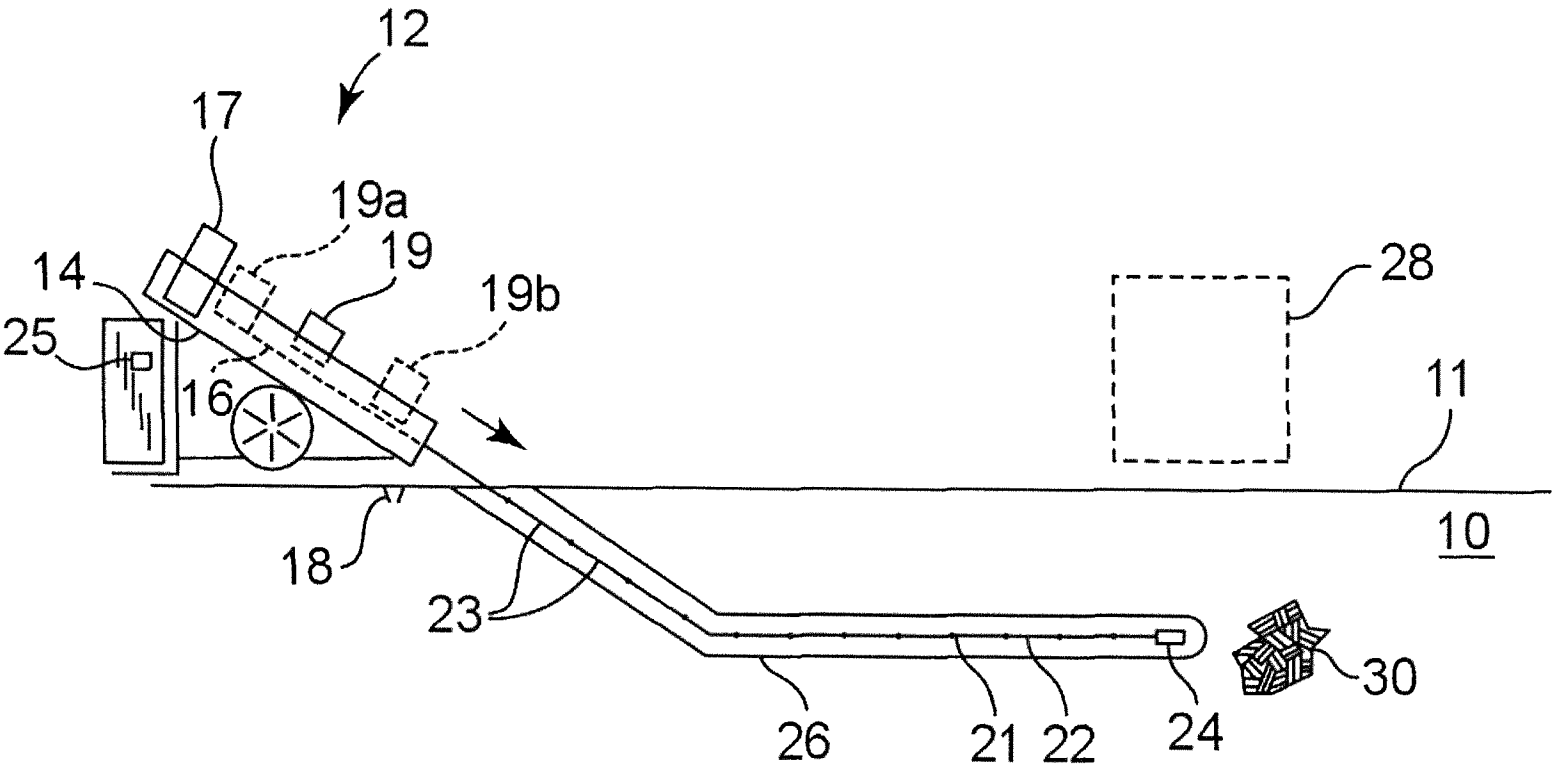
FIG. 1 illustrates various components of a horizontal directional drilling (HDD) system and a ground cross section showing down hole boring components in accordance with various embodiments of this disclosure.

While the invention is amenable to various modifications and alternative forms, specifics thereof have been shown by way of example in the drawings and will be described in detail herein. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF VARIOUS EMBODIMENTS

FIG. 1 illustrates a cross-section through a portion of ground 10 where a boring operation takes place. The underground boring system, generally shown as the boring machine 12, is situated aboveground 11 and includes a platform 14 on which is situated a tilted longitudinal member 16. The platform 14 is secured to the ground by pins 18 or other restraining members in order to resist platform 14 movement during the boring operation. Located on the longitudinal member 16 is a thrust/pullback pump 17 for driving a drill string 22 in a forward, longitudinal direction as generally shown by the arrow. The drill string 22 is made up of a number of drill string members 23 attached end-to-end. Also located on the tilted longitudinal member 16, and mounted to permit movement along the longitudinal member 16, is a rotation motor or pump 19 for rotating the drill string 22 (illustrated in an intermediate position between an upper position 19*a* and a lower position 19*b*). In operation, the rotation motor 19 rotates the drill string 22 which has a boring tool 24 attached at the distal end of the drill string 22.

A tracker unit 28 may be employed to receive an information signal transmitted from boring tool 24 which, in turn, communicates the information signal or a modified form of the signal to a receiver situated at the boring machine 12. The boring machine 12 may also include a transmitter or transceiver for purposes of transmitting and/or receiving an information signal, such as an instruction signal, from the boring machine 12 to the tracker unit 28. Transmission of data and instructions may alternatively be facilitated through use of a communication link established between the boring tool 24 and control circuitry 25 via the drill string 22.

A boring operation can take place as follows. The rotation motor 19 is initially positioned in an upper location 19*a* and rotates the drill string 22. While the boring tool 24 is rotated through rotation of the drill string 22, the rotation motor 19 and drill string 22 are pushed in a forward direction by the thrust/pullback pump 17 toward a lower position into the ground, thus creating a borehole 26. The rotation motor 19 reaches a lower position 19*b* when the drill string 22 has been pushed into the borehole 26 by the length of one drill string member 23. A new drill string member 23 is then added to the drill string 22 either manually or automatically, and the rotation motor 19 is released and pulled back to the upper location 19*a*. The rotation motor 19 is used to thread the new drill string member 23 to the drill string 22, and the rotation/push process is repeated so as to force the newly lengthened drill string 22 further into the ground, thereby extending the borehole 26. Commonly, water or other fluid is pumped through the drill string 22 (refereed to herein as mud) by use of a mud pump. If an air hammer is used, an air compressor is used to force air/foam through the drill string 22. The mud or air/foam flows back up through the borehole 26 to remove cuttings, dirt, and other debris and improve boring effectiveness and/or efficiency. A directional steering capability is typically provided for controlling the direction of the boring tool 24, such that a desired direction can be imparted to the resulting borehole 26. By these actions, and various combinations of these basic actions, a boring procedure can advance a boring tool 24 through soil, including advancing the boring tool 24 through a turn.

Conventional HDD requires at least one human operator overseeing operation of the boring machine. Even though the use of bore plans has simplified some boring machine operations, an operator is still required to match machine parameters and boring procedures with the tools being used. For example, hard soil patch 30 can be much denser then the surrounding soil. When the boring tool 24 encounters hard soil patch 30, a previously used boring tool and/or boring procedure may be relatively unproductive or even ineffective in making progress. Some types of boring tools and associated procedures are better suited to harder soil types than others, so a change in boring tools 24 and associated procedures can be necessary at the start of each bore hole as well as within the boring of a particular bore hole, such as when encountering hard soil patch 30. This is one reason why a variety of different boring tools have emerged for HDD.

Typically, a variety of different tools are brought to each work site to be selectively used as needed for boring. Typically, each tool is associated with different operating parameters (e.g., thrust pressure, rotation rate, etc.) and procedures (e.g., push without rotation, rockfire cutting procedure, etc.). While a machine controller can automate some boring procedures in conventional HDD, the boring machine controller must be programmed depending on which boring tool is being used, and then reprogrammed each time a tool swap is preformed.

Typical HDD procedures work by forcing a series of drill string members 23 (e.g., pipes) attached end-to-end underground to form a drill string 22. A proximal end of the drill string 22 is attached to an aboveground boring machine 14, which can advance, retract, and rotate the drill string 22, in addition to other actions. A boring tool 24 is attached at the distal end of the drill string 22 and serves as the leading edge of the drill string 22 as it bores through soil. Because HDD typically does not bore a hole very far from the surface of the ground, many belowground obstacles (e.g., sewers, electrical lines, building foundations, etc.) must be maneuvered around. As such, many boring tools are configured to allow the bore path to turn (e.g., left, right, higher, lower) to curve the bore path around underground obstacles.

Many boring tools facilitate turning by having an asymmetrical slanted distal end. For example, a boring tool may be slanted such that when it is forced through soft soil without rotation it deflects along the direction that it is slanted. Some slanted boring tools will bore along a straight path if they are continuously rotated (e.g., clockwise) while being forced forward by the boring rig. A straight path would be bored using the same tool because the rotation ensures that the boring tool will be slanted toward all orientations (e.g., left, right, higher, lower) momentarily in each 360 degree rotation, thereby carving out the profile of the tool.

Turning can be performed in harder types of soil by repeatedly rotating a slanted boring tool through limited arcs. For example, a boring tool may be rotated clockwise 180 degrees and then rotated counterclockwise 180 degrees. This clockwise-counterclockwise rotation procedure can be repeated as the leading edge of the slanted boring tool carves out a particular side of the bore hole. The boring tool will then curve in the direction that is being carved out as the tool is forced forward. The use of fluid jets and articulating boring tools can also facilitate boring and turning maneuvers.

Many different boring actions can be taken during a boring procedure for effectively and efficiently advancing the boring tool forward and/or along a curve of a bore plan path. Such actions include increasing or decreasing pressure on the drill string (push pressure), clockwise rotation or counterclockwise rotation of the drill string and boring tool, and increasing or decreasing mud flow, among others. These actions can be performed in various combinations to provide a great variety of different boring and turning maneuvers available to a drill operator.

For example, several autodrill functions can be available to a machine operator. Autodrill functions can automate some or all outputs of the boring rig to conduct HDD according to certain parameters (e.g., automate boring machine 14 manipulation of the drill string 22). For example, a user can input a certain thrust pressure using an interface and a controller will modulate the machine functions (e.g., rotation pressure and speed, push pressure, etc.) to maintain the input thrust pressure. Other autodrill modes can maintain constant rotation torque, constant rotation rate, or drill string advancement rate, among other parameters. However, not all autodrill modes are appropriate for all tools. For example, a constant drill string advancement rate autodrill mode may be damaging to a tool that should not be subject to too much pressure, whereby in the constant advancement rate autodrill mode the pressure on the tool may dramatically increase as harder soil is encountered. Conventional HDD requires the machine operator to be knowledgeable in which autodrill modes are appropriate for which tools to properly match tools with autodrill modes and avoid such issues.

Therefore, a competent drill rig operator must be knowledgeable in not only how to perform each of the available maneuvers, but also which set of actions and mode are appropriate for use with which tools. Also, each type of tool can have particular operational parameters at which the boring tool operates most effectively and/or efficiently. For example, a particular tool may bore most efficiently at a particular rotation rate and/or at a particular push (thrust) pressure. Moreover, each type of tool can have operational parameter limits within which the tool can effectively bore without causing damage to the tool, drill string, or rig. For example, a particular tool may be designed to withstand only a limited amount of thrust pressure at a given rotation rate.

The result is that proper HHD may require at least one highly skilled human operator matching the appropriate boring parameters and procedures with the boring tools available at the project site. The attention required by such a HDD specialist substantially increases drilling costs, and can distract from other important HDD operations, such as active obstacle detection. Moreover, even a skilled HDD rig operator may not always be able to determine which of a variety of different drilling procedures would be effective and/or efficient with a particular tool.

Apparatuses and methods are provided herein for facilitating faster and more accurate boring machine programming, as well as for enhanced tracking of boring head usage and productivity while diminishing the need for constant decision making from a highly skilled human HDD operator. For example, apparatuses and methods of the present invention can provide for quickly determining which boring procedure and operational parameters are optimal for use with one or more selected tools.

In some embodiments, a HDD system is automatically programmed with the operational parameters appropriate for which tool is selected to be attached to the drill string. The HDD system can also be programmed to automatically carry out which boring procedure is best matched to a selected boring tool (e.g., an autodrill mode matched to a tool), which can be facilitated by a processor executing program instructions stored in memory. However, in some embodiments of the invention, a human operator is prompted (via display, audible signal, etc.) to program or implement particular parameters and procedures that are matched by circuitry to a selected boring tool.

The display of operational boring parameters and/or programming of operational boring parameters and procedures into a controller based on a boring tool being selected are facilitated by a tool library. A tool library stores (e.g., in computer readable memory) information associated with a variety of different tools. A library, or a customized directory thereof, may be based on tool profiles of all boring tools known to exist, all tools from a particular manufacturer or supplier, all tools owned by a particular company, all tools at a particular job site, all tools previously used at a particular job site or under certain conditions (e.g., in soft soil or in the state of Iowa), or all tools compatible with a particular boring machine, among others.

In some embodiments, a tool library can be a reduced set of a broader library. For example, a customized directory can be formed based on all tools present at a particular job site that are also compatible with a particular boring machine at the job site (i.e. a customized directory can be formed composed of only those boring tools appearing in two other specific categories).

A tool library can contain specific information for each of the tools within the library. For example, a library can include the thrust pressure limits and optimum rotation rates for optimum boring efficiency, among other parameters, associated with a particular tool. This information can be collected through a number of sources, including manufacturer suggested parameters, design limits, analysis of tool performance data, past experience using the tool, and/or as determined by a boring specialist. This information can be automatically programmed by a controller of a HDD machine such that a human and/or autodrill program must stay within the limits during boring operations.

For example, a tool library may indicate that a particular boring tool should not be subjected to more than 500,000 pounds of axial force. A controller can be programmed with this and other information based on a tool profile of the particular boring tool being selected from the library by a user. Thereafter, if the boring machine is made to subject the particular boring tool to more than 500,000 pounds of axial force (e.g., based on an input by a human operator or by way of an automated drill program) then the controller will limit the thrust output of the thrust pump to prevent 500,000 pounds of axial force from being developed. In this way, a controller can be programmed with a particular tool profile based on the particular tool profile being selected from the tool library and the controller will manage operation of the HDD machine such that the operational limits of the tool as indicated in the tool profile are not exceeded.

A tool library can additionally or alternatively contain information indicating one or more preferred operating parameters for each tool in the library. A boring machine can be automatically programmed with preferred operating parameters based on user selection of a tool profile associated with a tool. For example, preferred operating parameters can include one or more of thrust pressure, rotation speed, rotation direction, rotation torque, mud flow rate, and combinations thereof (e.g., particular thrust pressure for a given rotation rate or a formula for calculating the same) that provide for optimum boring efficiency and/or effectiveness based on the characteristics of each tool. The tool library can further associate this information with soil conditions such that based on the present soil conditions and on an input indicating which boring tool is selected for use (e.g., by selection of the associated tool profile from the tool library), rotation rate, rotation torque, thrust pressure, and mud flow rate parameters are all displayed and/or automatically implemented as outputs by the controller to the various motors.

As discussed previously, a turn my be executed by a procedure in which a boring tool is quickly and repeatedly rotated through limited but repeated counterclockwise and clockwise rotations such that the boring tool never makes a complete rotation (referred to as a "wiggle"). Many boring tool bits are configured such that the bits make the greatest cut of soil when rotated in one direction, either clockwise or counterclockwise. Therefore, which rotational direction each boring tool is configured to cut, and how many degrees of rotational wiggle is appropriate, is information that can be stored for each tool in a tool library as part of an operational tool profile and be automatically programmed into a machine controller when the tool is selected for use.

Many other variations on boring procedures, including autodrill programs, can be contained in a tool library and can further be automatically executed by a controller when a boring tool is selected for use by selection of a tool profile associated with the tool. For example, thrust pressure can be applied through the drill string while the boring tool is rotated through a clockwise angle, but not applied when the boring tool is rotated through a counterclockwise angle. Also, thrust pressure can be applied through the drill string while the boring tool is rotated through a clockwise angle, and retraction pressure (pulling the boring tool back slightly) can be applied when the boring tool is rotated through a counterclockwise angle. Lack of thrust pressure, or actual refraction of a boring tool, while the boring tool is rotated through the angle in which the bit typically does not make a cut in the soil can allow the soil face previously cut to remain relatively undisturbed before the next cut is made.

In accordance with another steering procedure of the present disclosure which employs a rockfire cutting procedure, the boring tool is thrust forward until the boring tool begins its cutting action. Forward thrusting of the boring tool continues until a preset pressure for the soil conditions is met. The boring tool is then rotated clockwise through a cutting duration while maintaining the preset pressure. In the context of a rockfire cutting technique, the term pressure refers to a combination of torque and thrust on the boring tool. Clockwise rotation of the boring tool is terminated at the end of the cutting duration and the boring tool is pulled back a preset distance or until the pressure at the boring tool is zero. The boring tool is then rotated clockwise to the beginning of the duration. This process is repeated until the desired boring tool heading is achieved. Rockfire cutting action is only suitable for certain boring tools. A tool library can indicate which boring tools are appropriate for use with a rockfire cutting procedure such that when the profile of a tool is presented on a display screen, the display screen indicates whether a rockfire cutting procedure can be used with the boring tool presented on the display screen. If the tool which is indicated by the library to be associated with the rockfire cutting procedure is selected for use, then a controller can automatically control signals to the motors of the HDD machine (e.g., thrust/pullback pump 17 and rotation motor or pump 19) to carry out the actions composing the rockfire cutting procedure. The other procedures referenced herein or otherwise recognizable upon reading this disclosure can also be carried out in this manner.

Boring procedures can include the delivery of a fluid, such as a mud and water mixture or an air and foam mixture, to the boring tool during excavation. A human operator and/or a controller can control various fluid delivery parameters, such as fluid volume delivered to the boring tool and fluid pressure and temperature, for example. The viscosity of the fluid delivered to the boring tool can similarly be controlled, as well as the composition of the fluid. For example, a rig controller may modify fluid composition by controlling the type and amount of solid or slurry material that is added to the fluid.

Composition of fluid and/or rate of delivery can be based on the type of boring tool selected from the library, as some boring tools may operate more effectively and efficiently with some types of fluid compositions and/or delivery rates and other boring tools will operate more effectively and efficiently with other fluid compositions and/or delivery rates. The tool library can include optimum fluid compositions and/or delivery rates stored in each operational profile for each boring tool, such that when a particular profile is selected the optimum fluid composition and/or delivery rate associated with the selected boring tool are displayed and/or automatically programmed into a machine controller that automatically controls fluid composition and/or delivery rate during boring based on the profile selection.

Boring actions can include physical modification of the configuration of the boring tool. The configuration of the boring tool according to soil/rock type and boring tool steering/productivity requirements can be controlled to optimize boring effectiveness and efficiency. One or more actuatable elements of the boring tool, such as controllable plates, duckbill, cutting bits, fluid jets, and other earth engaging/penetrating portions of the boring tool, may be controlled to enhance the steering and cutting characteristics of the boring tool. In an embodiment that employs an articulated boring tool, a controller may modify the head position, such as by communicating control signals to a stepper motor that effects head rotation, and/or speed of the cutting heads to enhance the steering and cutting characteristics of the articulated boring tool. The pressure and volume of fluid supplied to a fluid hammer type boring tool, which is particularly useful when drilling through rock, may be modified.

A boring tool that can undergo physical modification to alter its cutting or turning characteristics may have a general use configuration, such as a default setting, appropriate for most conditions. The general use configuration may include a manner of operation, such as moving cutting bits or fluid jets. The tool library can contain information regarding how a dynamic/articulate-able boring tool is to be controlled to carryout a general use function and/or a specialized use function (e.g., constant rotation of cutting bits when thrust pressure is applied) in each operational profile for each boring tool having such capabilities. This information can be displayed and/or automatically programmed into a machine controller that controls boring tool function during boring to implement the general and/or specialized function of a dynamic/articulate-able boring tool when the associated operational tool profile is selected.

As demonstrated above, many procedures for properly using HDD tools comprise operational changes in boring procedure, and not merely an adjustment in an output parameter, such as thrust. As such, the information stored in the library and executable by a controller upon boring tool profile selection may contain not only ideal operating parameters, but also information regarding a plurality of whole individual boring procedures each composed of a different combination of boring actions matched to boring tools that can be automatically carried out by a HDD machine to effectively employ these procedures. A tool library in accordance with the present disclosure may organize this information such that a user can quickly scroll through tool profiles and select a particular tool for use. The relevant operational information (e.g., parameters and procedures) will then readily be available to the operator, and can be programmed into a controller to carry out automated boring procedures and/or maintain default or customized boring parameters.

Referring to FIGS. 2A-B and 3A-B, interface screen shots 200, 201, 300, and 301 are shown. Screen shots 200 and 201 show different versions of the operational tool profile for a fluted reamer and screen shots 300 and 301 show different versions of the operational tool profile of a TRIHAWK tool, along with sample parameters and procedures that can be indexed to the tools. A control system of the present disclosure can store operational parameters and operating procedures (e.g., default control parameters) associated with each of the HDD machine attachments as part of a tool library, the information indexed to the respective tool profile associated with the tools. The user interface is configured such that the operator can scroll through a list of attachments and select the desired attachment. The control system automatically populates the default machine settings based on the selected attachment.

Figure 2A:
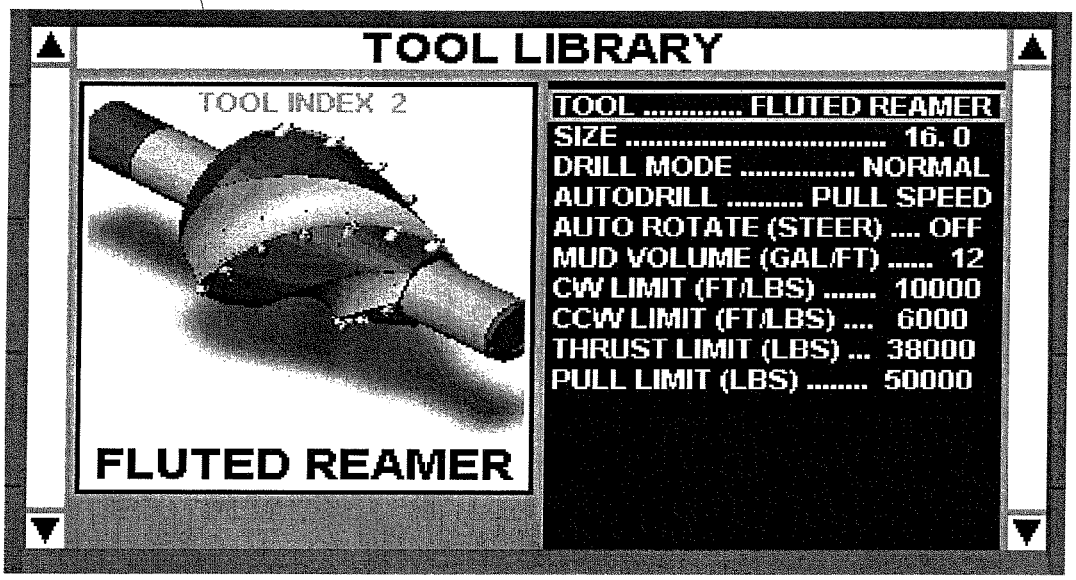
FIG. 2A is a screen shot of a cutting tool and its corresponding default machine settings in accordance with various embodiments of this disclosure.
Figure 3A:
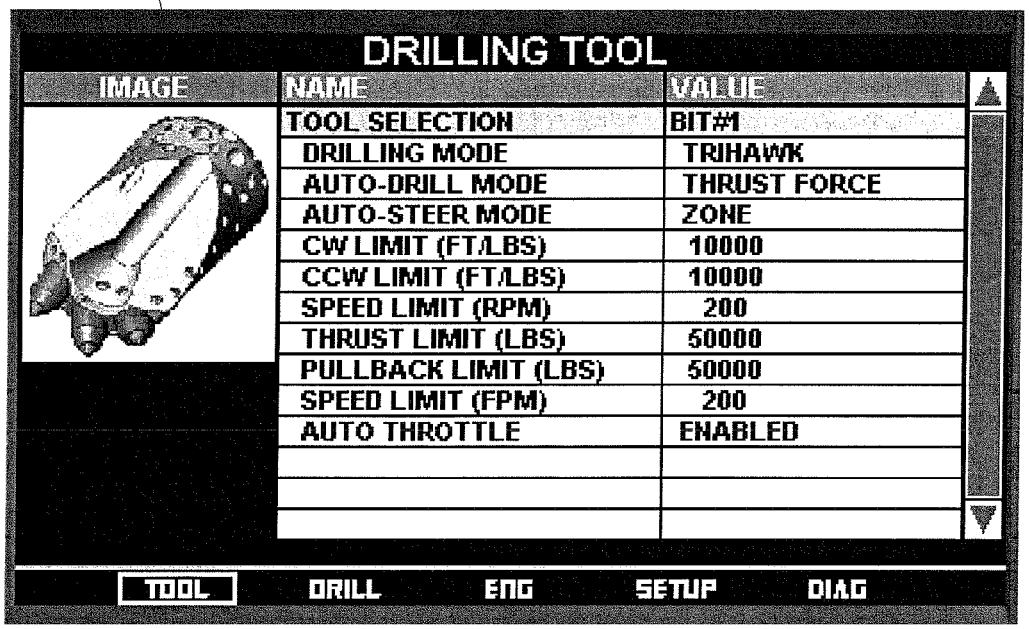
FIG. 3A is a screen shot of a cutting tool and its corresponding default machine settings in accordance with various embodiments of this disclosure.

As depicted in FIGS. 2A and 3A, each attachment corresponds with nine default machine settings. The default machine settings categories include: (1) Tool Size, which can be, for example, the diameter of the tool in inches; (2) Drill Mode, which can be, for example, NORMAL, ROCKFIRE, TRIHAWK modes; (3) Auto-Drill Mode settings, which can be, for example, OFF, PULLBACK SPEED, THRUST FORCE, ROTATION TORQUE; (4) Auto-Steering settings, which can be, for example, OFF, ROCK, ZONE; (5) Mud Volume which can be, for example, OFF, X Gallons Per Foot; (6) Clockwise Limit, which can be, for example, X Ft/Lbs; (7) Counterclockwise Limit, which can be, for example, X Ft/Lbs; (8) Thrust Limit, which can be, for example, X Ft/Lbs; and (9) Pullback Limit, which can be, for example, X Lbs. Other parameters and operating modes as discussed herein or otherwise recognizable upon reading this disclosure can be included for each tool in a tool library. The above-identified setting categories are fields in which the user might otherwise have to manually set based on the operator's experience or based on field manual settings.

Figure 2B:
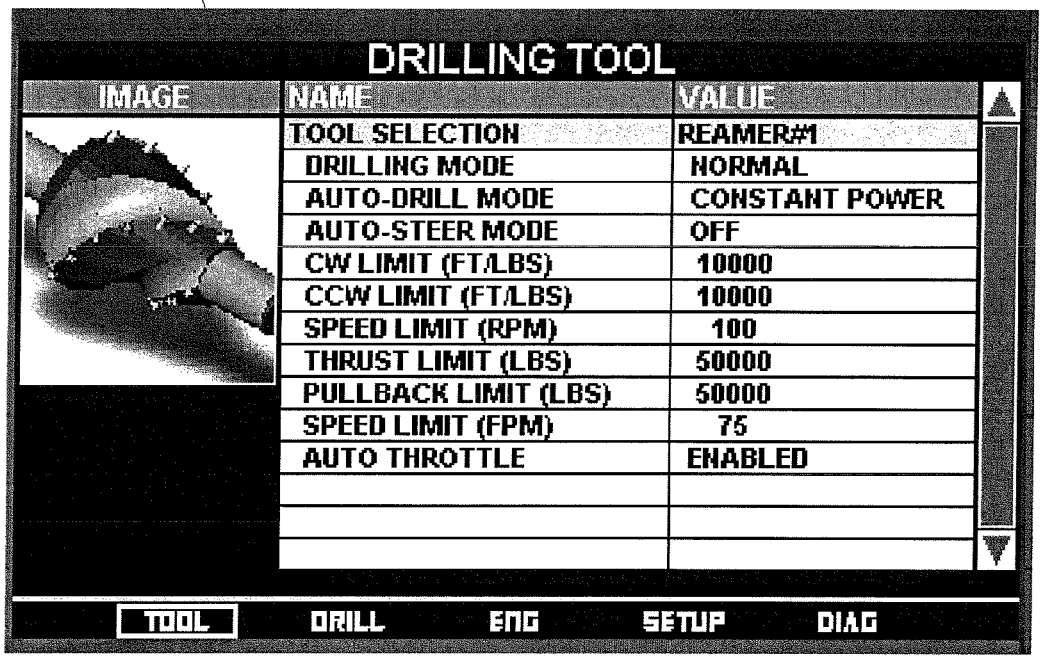
FIG. 2B is a screen shot of a cutting tool and associated machine settings in accordance with various embodiments of this disclosure.
Figure 3B:
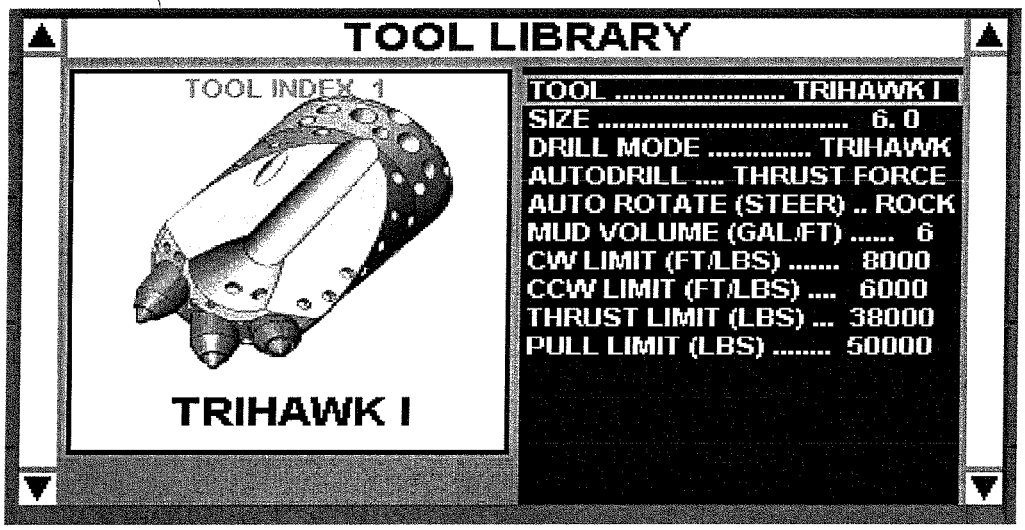
FIG. 3B is a screen shot of a cutting tool and associated machine settings in accordance with various embodiments of this disclosure.

In FIGS. 2B and 3B, different operational parameters are shown for the tools. For example, a constant power autodrill mode is selected for the reamer tool as shown in FIG. 2B. A constant power autodrill mode can include automatic modulation of output HDD machine motors controlled by a control circuit to maintain constant power output. The thrust force autodrill mode of the tool of FIGS. 3A-B can include automatic modulation of output HDD machine motors (e.g., rotation) controlled by a control circuit to maintain constant thrust.

Figure 4:
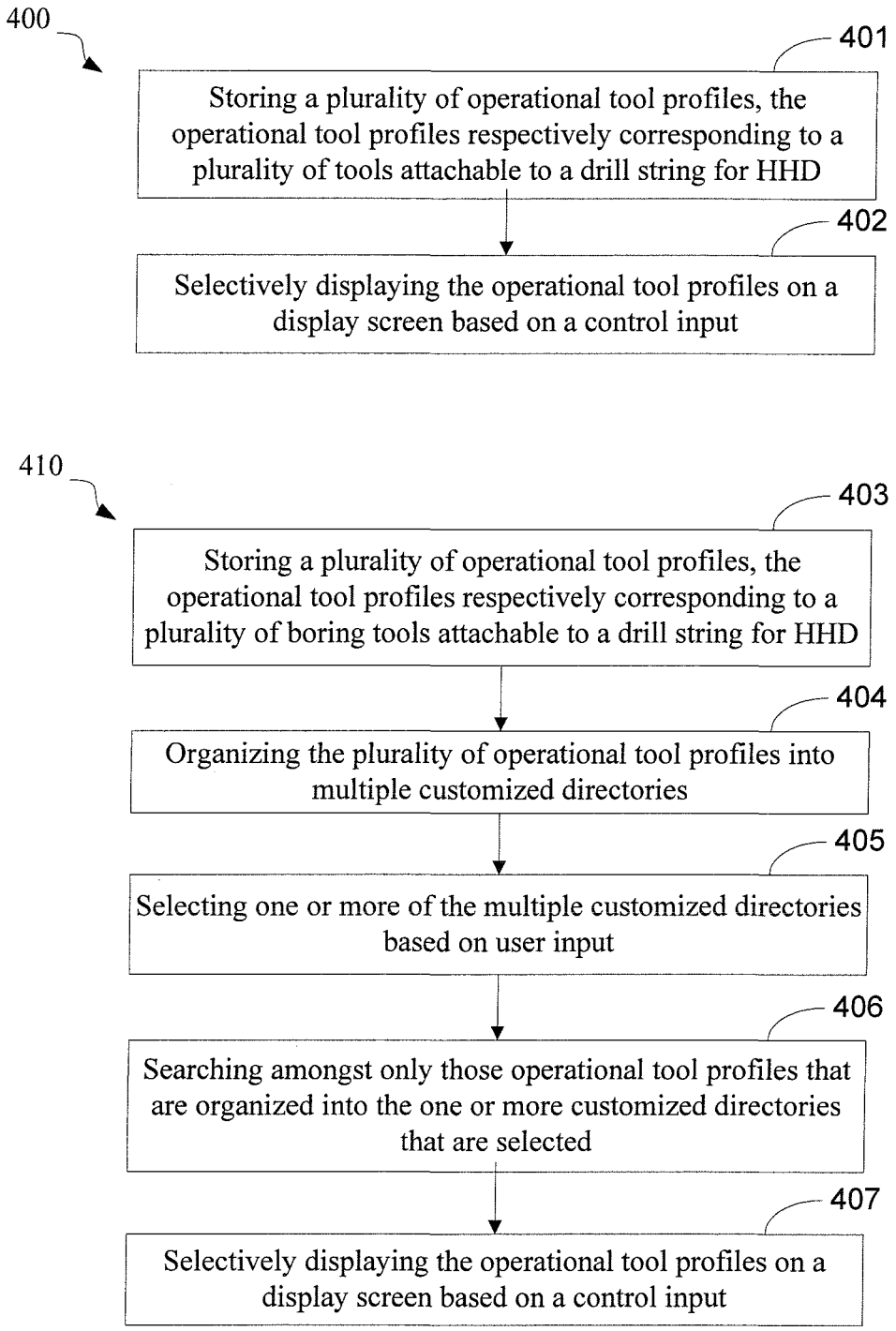
FIG. 4 illustrates two flow charts for carrying out HDD with a tool library in accordance with various embodiments of this disclosure.

FIG. 4 illustrates two flow charts according to the present disclosure. One flow chart concerns a method 400 that includes storing 401 a plurality of operational tool profiles, the operational tool profiles of the plurality respectively corresponding to a plurality of tools attachable to a drill string for HHD. Each of the operational tool profiles can contain operating parameters for the boring tool of the plurality with which the operational profile is associated. The profiles can be stored in memory, such as flash or disk memory, that is part of a HDD rig or remote from the HDD rig.

In some embodiments of the method 400, the operating parameters of each operational tool profile comprise operational boring parameter limits for the tool of the plurality with which the operational profile is associated. Such operational boring parameter limits may be, for example, maximum thrust pump pressure or drill string advancement rate, maximum rotation torque, maximum rotation pump pressure, maximum rotation rate, and maximum fluid delivery viscosity and/or deliver rate, among other parameters discussed herein or otherwise recognizable upon reading this disclosure.

The method 400 further includes selectively displaying 402 the operational tool profiles on a display screen based on a control input, such as a user input. The profiles are selectively displayed because a user can scroll amongst the profiles, and can view one or more of the profiles as desired by the user.

In some embodiments of the method 400, the operating parameters of each operational tool profile contain information regarding one or more drill modes that the tool of the plurality with which the operational profile is associated is suited to execute. Such drill modes can be, for example, an autodrill mode or rockfire cutting, among other drill modes referenced herein or otherwise recognizable upon reading this disclosure.

In some embodiments of the method 400, the operating parameters of each operational tool profile include information regarding one or more automated drill modes that the tool of the plurality with which the operational profile is associated is suited to execute. Such automated drill modes can be, for example, a predetermined series of different boring actions that can be automatically executed and/or maintained by control circuitry. In some embodiments, an autodrill mode is carried out automatically by control circuitry to control thrust pump and rotation pump outputs to maintain one of a constant thrust pressure, constant drill string advancement, constant rotation torque, or constant drill string rotation rate.

The present disclosure also provides a means to customize the tool settings through use of a tool library. For example, an operator can adjust the settings away from default settings of the library to better adapt the machine to a particular drilling/boring application. In particular, the control system provides a pre-defined number of available tool indexes. Each tool index can be assigned to any of the available tools in the tool library. If desired, the control parameters associated with that tool can be changed and are then saved to that tool index. This allows the operator to customize the tool library such that a particular tool can have several programmed settings (e.g., parameter limits and boring procedures). For example, a boring tool may have default settings associated with general boring saved to the tool index associated with the particular tool. A boring specialist may customize another set of boring parameters and/or procedures for the boring tool based on, for example, previous use of the boring tool at a particular work site. Subsequently, a boring machine operator can scroll through the tool library to select the particular tool, and further select the general use parameters or the customized parameters depending on, for example, whether the hole to be bored is at the same work site at which the customized parameters were developed or a different work site. Therefore, some embodiments of this disclosure allow an operator to select customized preset machine settings corresponding to a particular attachment (tool) in addition to, or in place of, the default machine settings that correspond to the attachment. Each of the default and customized settings can be apart of the same operational tool profile, such that after selection of a particular tool profile a user can then select between the default and customized settings to be displayed and/or automatically implemented by a HDD machine having a controller in a autodrill mode, for example.

Various embodiments of this disclosure also include a customized directory of attachment tools. A customized directory can include the tool profiles for all tools of the library meeting one or more conditions. For example, a customized directory can include only those tools which can be fitted to a machine or used with a certain component (e.g., only those boring tools that can be attached to a certain type of drill string pipe). A customized directory can also be created for all tools owned by a company. A customized directory can also be created for all tools available at a particular job site. Once a customized directory is created and the tool index numbers are assigned, the operator can then quickly select the tool to be used from the customized directory without having to scroll through the entire list of tools in the library. Use of a customized directory in this way allows for a user to browse through a reduced set of tool profiles of a tool library instead of scrolling through all tool profiles in the library to identify the tool to be used by way of profile selection.

Such customization can be used in the method 410 of FIG. 4. In step 403, a plurality of operational tool profiles are stored 403, each of the operational tool profiles respectively corresponding to a plurality of boring tools attachable to a drill string for HHD, as in steps 401. The plurality of operational tool profiles can then be organized 404 into multiple customized directories. Each customized directory may correspond to, for example, the boring tools available at a particular job site. One or more of the multiple customized directories can then be selected 405 based on user input and a search 406 can be performed amongst only those operational tool profiles that are organized into the one or more customized directories that were selected 405 based on user input. Based on this reduced set of operational tool profiles, one or more operational tool profiles can be selectively displayed 407 on a display screen based on a control input, as in step 402. One of these profiles can further be selected for use as discussed herein.

In some embodiments, a bore hole is made using a boring tool associated with a selected operational profile of a plurality of operational profiles, such as one of the plurality of operational profiles in step 401 that has been selected. The operational profile may be selected based on that operational profile being displayed during boring, which indicates that the associated boring tool is being used. During this boring, boring data is collected, the boring data indicating the efficiency and/or effectiveness of the currently used boring tool. The boring data is then saved in memory, the boring data being indexed to the operational profile of the selected operational profile (and thereby the selected boring tool). When the same boring profile is subsequently displayed, the boring data, and/or a metric derived from the boring data, can be displayed as part of the profile, as in step 402. Such a procedure allows the efficiency and/or effectiveness of the boring tool to be tracked and compared with other boring tools, wherein boring data was collected, saved, and indexed in the same fashion for the other boring tools.

Figure 5:
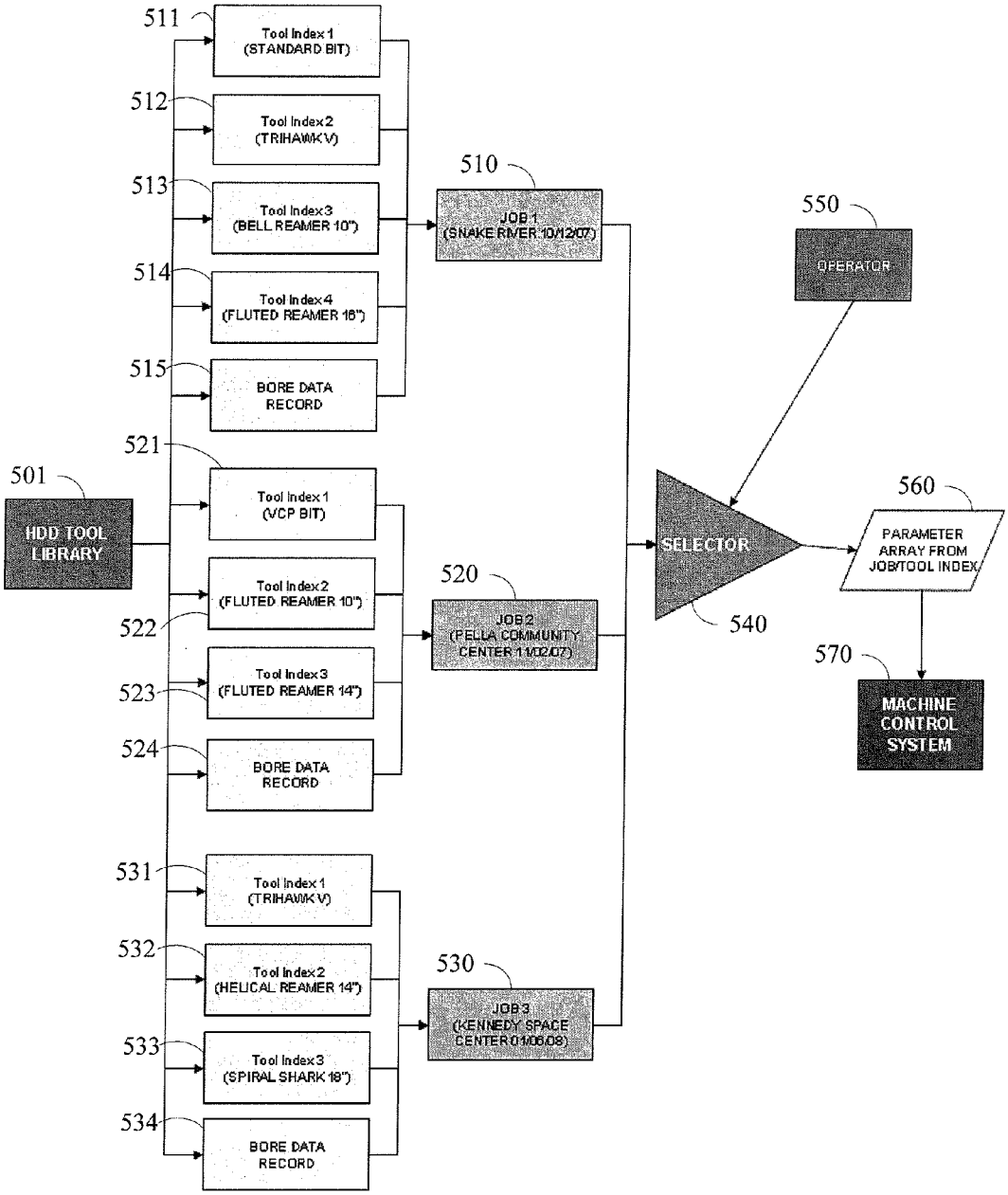
FIG. 5 is a flow diagram illustrating how data is organized and stored in a job database.

Referring to FIG. 5, the present disclosure also provides a job database. A predefined number of job databases can be used to save the tool index selections for that specific job. This allows the operator to set up a customized directory for specific job types before beginning the job. It also allows the operator or others to analyze data concerning work at the job site after the job is finished or at any intermediate stage in the process. The ability to set up the machine before arriving at the job site can make the entire process more predictable and efficient. For example, a boring specialist can set up a customized directory of tools 511-514 for a job 510 based on what the boring specialist knows about the project at the job 510. Some of the tool profiles can be customized for what the specialists thinks would be optimal for the conditions at the job 510 (e.g., such as including programming instructions in the profile of tool 511 for performing a customized rockfire cutting routine that can automatically be executed by a machine controller in addition to default settings). A machine operator can then be sent to the job 510 site with the physical attachment tools (boring tools) corresponding to the attachment tools 511-514 of the directory customized for the job 510. The machine operator then has far fewer options from which to select when on site, but the options are customized by the specialist and therefore the work of the machine operator has been simplified. Also, as with use of a tool library generally, the likelihood of the operator mismatching particular tools with inappropriate parameters and/or operating procedures is minimized. In this way, work may be carried out at the job 510 site without the need for the boring specialist at the job site, which can lower overall costs associated with HDD.

Multiple customized directories (e.g., 511-514, 521-523, and 531-533) can be made, each corresponding to different job sites (510, 520, and 530 respectively). Therefore, even though a machine may be used at job 520 for a week, then job 530 for a week, and then be returned to job 520, a machine operator can select a customized directory associated with job 520 and thereby get a list of boring tools 522-524 that are, for example, present at the job site, pre-selected for use at the job site, or previously used at the job 520 site, depending on how the customized directory for that job 520 site is organized.

In the depicted embodiment, three jobs are saved (510, 520, and 530). Four tools 511-514 are associated with job 510, and three tools 521-523 and 531-533 are associated with jobs 520 and 530, respectively. In alternative embodiments any number of jobs might exist, and each job could be associated with any number of tools.

In the depicted embodiment, each job 510, 520, and 530 is respectively associated with bore data record 515, 524, and 534, which tracks and stores feedback information from the machine and other relevant job-related data. Feedback information can include productivity information, such as feet bored per hour with a particular boring tool, among other metrics of productivity and effectiveness. Feedback information can also include sensor data taken during boring. For example, bore data record 515 may indicate that when the standard bit tool 511 was used the hydraulic pump pressure indicated that 6,000 PSI was generated, which can indicate that the boring tool 511 was being pushed too hard relative to how much boring progress was being made. Based on this bore record data 515, a different boring tool from the customized directory may be selected 540 (e.g., TRIHAWK tool 512).

Various techniques can be used to evaluate boring effectiveness and progress, the result of which can be indexed to various tool profiles and used to select between tools of a tool library 501. For example, an aboveground scale or flow rate sensor in the bore hole can calculate the amount of mud exiting the bore hole and compare these measurements to the amount of mud pumped into the bore hole. The greater the difference can indicate a greater level of cuttings and a greater level of boring progress. The difference between mud in/mud out can also be divided by time to determine a material removal rate as an effectiveness and efficiency parameter. Also, the rate of material removal from the borehole as a progress, efficiency, and/or effectiveness parameter, measured in volume per unit time, can be estimated by multiplying the displacement rate of a boring tool by the cross-sectional area of the borehole produced by the boring tool as it advances through the ground.

The rate at which a boring tool is displaced along the underground path during drilling or back reaming for a given pressure applied through the drill string typically varies as a function of soil/rock conditions, length of drill pipe, fluid flow through the drill string and boring tool, and other factors. Such variations in displacement rate typically result in corresponding changes in rotation and thrust/pullback pump pressures, as well as changes in engine/motor loading, among other parameters. Therefore, tool displacement, drill string length, and pressure parameters, among other things, can be tracked to indicate boring effectiveness and efficiency associated with a particular tool attachment and input parameters.

In one embodiment the bore data record may include time-at-level data for a set of primary control functions. The primary control functions, for example, may include: clockwise rotation torque; counterclockwise rotation torque; rotation temperature; thrust force; pull back force; mud pressure; and mud flow rate. Each of these control functions can be given a normalized range to measure its intensity. For example, the intensity of the clockwise rotation torque can be expressed with a number from zero to one hundred. Zero corresponding to a minimum clockwise rotation torque level (e.g., 0.0 Ft/Lbs) and one hundred corresponding to a maximum clockwise rotation torque level (e.g., 20,000 Ft/lbs).

The range (0-100) can be divided into equal sections (e.g., 1-20, 21-40, 41-60, 61-80, and 81-100). The time-at-level data would represent the time that the machine was in each of the sections. For example, the time the clockwise rotation was in its lowest range (1-20) during a particular job could be expressed in minutes, or the time the pull back force was in its upper mid range (41-60) could be expressed in minutes.

The time-at-level data can be useful to the operators and specialists in their attempts to optimize the performance of the drilling machine. It can also provide a better understanding of the types of materials that they are drilling through. The time-at-level data can also be used to estimate the useful life of various components of the machine, including the attachments themselves. For example, the time-at-level data stored in the bore data record 524 and indexed to a particular tool may indicate that VCP bit 521 is about to exceed its recommended working life (e.g., 1000 hours of boring), and that a replacement of this boring tool is recommended. The time-at-level data can also be useful to an individual who services the machine, as it provides the individual insight as to how the machine was used and how the machine performed under those conditions. This information can be presented on a display of the boring machine and/or transferred back to a servicing center.

Collection of time-at-level data, as well as other tool specific data stored in the bore data records 515, 524, and 534 can aid the replacement of machine operators with a minimum of disruption. For example, time-at-level data can be collected in the bore data record 534 indexed to a particular tool 533 while a first operator operates the boring machine. The next day a different operator can view the time-at-level data to determine which attachments tool or tools were principally used the previous day, and resume using the same tool(s) and boring procedure(s) at the same level(s).

Bore data records associated with specific tools can also keep data indicating how effecting and/or efficient particular tools have been at particular job sites, or generally. For example, metrics can be displayed in a tool profile to indicate how effective and/or efficiently a boring tool operates. Additionally, metrics can be displayed in a tool profile to indicate effectiveness and/or efficiency of one or more boring procedures associated with a boring tool. Such information can help an operator select a boring tool from a tool library.

Selection of a boring tool (e.g., by selection of its associated operational tool profile) can be done by an operator 550 reviewing information associated with boring tools as indexed in the tool library 501 and displayed on a display screen. In some embodiments, a profile is selected by it being displayed on a screen, the assumption being that as long as the user keeps the profile on the screen then the user is using the tool. In some embodiments, selection of a profile may be performed by pushing a button or otherwise manipulating an input device to indicate selection by a user of a profile relative to other profiles of a tool library (and thereby selection of a tool associated with the selected profile relative to other tools of the library).

Selection of a boring tool can also be performed automatically by circuitry 540 based on any of the metrics discussed herein, such as based on a comparison between an effectiveness parameter, an efficiency parameter, time-at-level data (selection based on greater prior use), and/or productivity parameter, among other parameters discussed herein. Based on tool selection, parameter array information 560 from the library 501 can be manually or automatically programmed into a machine control system 570 to carry out HDD boring operations as described herein.

Figure 6:
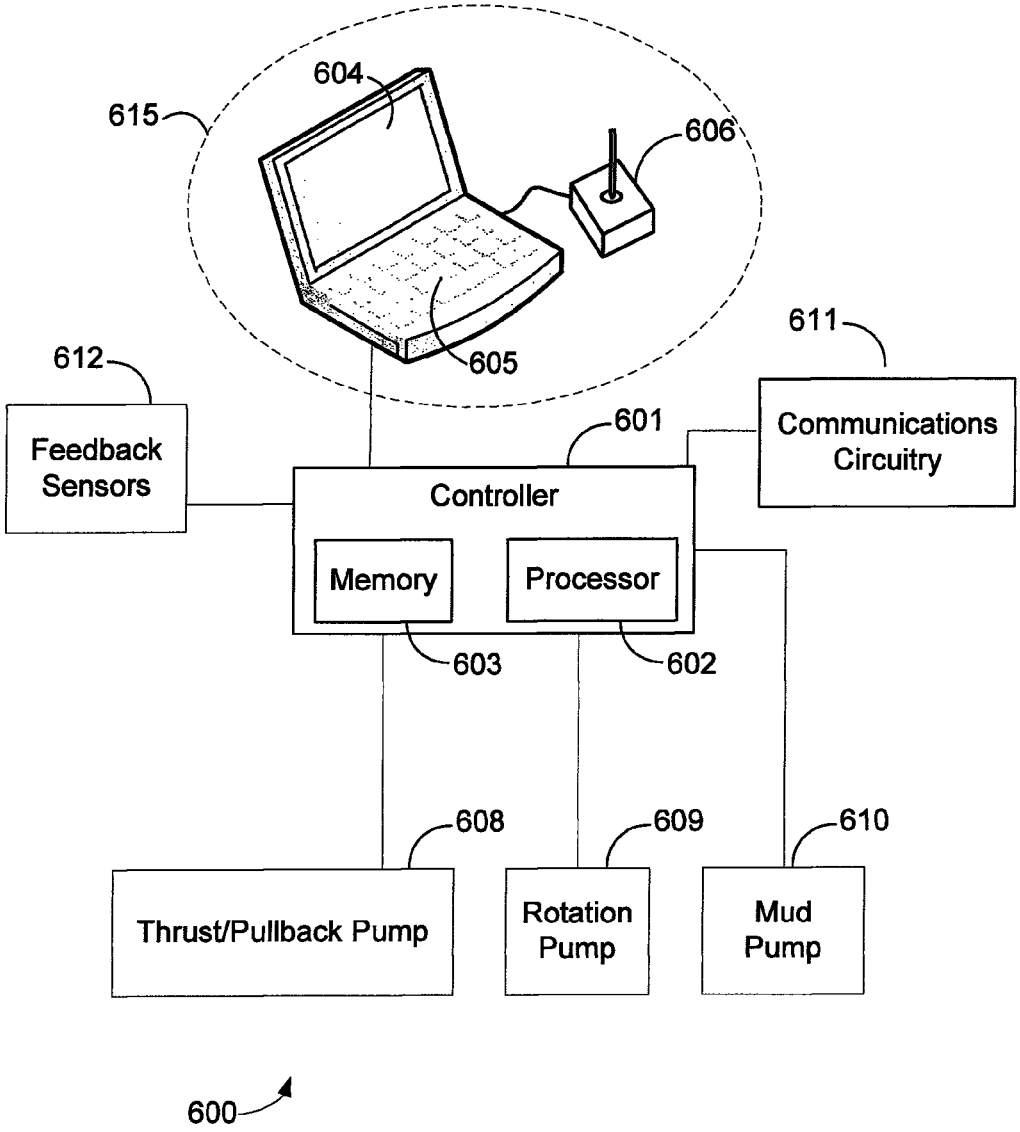
FIG. 6 illustrates a block diagram of a HDD system circuitry and components for carrying out HDD with a tool library in accordance with various embodiments of this disclosure.

FIG. 6 illustrates a circuitry block diagram. The circuitry 600 of FIG. 6 includes a controller 601, which can facilitate and control boring operations as described herein. The controller 601 can include processor 602 and memory 603.

Embodiments can use memory 603 coupled to the processor 602 to perform the processes described here. Memory can be a computer readable medium encoded with a computer program, software, computer executable instructions, instructions capable of being executed by a computer, etc, to be executed by circuitry, such as processor 602. For example, memory can be a computer readable medium storing a computer program, execution of the computer program by a processor causing storage of a plurality of operational tool profiles in memory, the operational tool profiles of the plurality respectively corresponding a plurality of tools attachable to a drill string for HHD and each of the operational tool profiles of the plurality including operating parameters for the boring tool of the plurality with which the operational profile is associated, and selective display of the operational tool profiles on a display screen based on a control input. In similar ways, the other methods and techniques discussed herein can be performed using the circuitry represented in FIG. 6.

Boring operation can be carried out by the controller 601 monitoring feedback signals from the feedback sensors 612 (e.g., a sensor measuring hydraulic pressure in the thrust/pull back pump 608) and controlling the outputs of the thrust/pull back pump 608, rotation pump 609, and mud pump 610. The controller 601 can carryout boring procedures, such as rockfire cutting and autodrill modes, as described herein by controlling the outputs of the thrust/pull back pump 608, rotation pump 609, and mud pump 610, among other components of a HDD machine. For example, the controller 601 can output a signal to the thrust/pull back pump 608 to cause it to move a drill string proximally (out of the bore hole) or distally (into the bore hole), output a signal to the rotation pump 609 to cause it to rotate the drill string, and output a signal to the mud pump 610 to cause it to deliver fluid though the drill string. In this way, circuitry 600 can automate the various boring procedures discussed herein based on procedures indexed to a selected operational boring tool profile.

A user interface 615 provides for interaction between an operator and the boring machine. The user interface 615 can include a display screen 604 and various inputs, such as a keypad 605 and a joystick 606. A user can view profiles of tool attachments on the display screen 604, as well as monitor boring parameters.

The inputs of the user interface 615 can allow a user to manually control operation of the boring machine, such as the outputs of the thrust/pull back pump 608, rotation pump 609, and mud pump 610. While manually controlling the boring machine, the user can also monitor feedback parameters displayed on the display screen 604 as collected by the feedback sensors 612. The optimal and/or maximum parameters of the currently selected attachment tool as indicated by a selected profile of a tool library can simultaneously be displayed on the display screen 604 to help the user maintain optimal machine outputs (e.g., thrust from the thrust/pull back pump 608) while also allowing the user to operate the boring machine under manual control. If the currently used attachment tool is switched, then the new attachment tool (e.g., a TRIHAWK) can be selected from the tool library and the profile of that tool can be displayed, along with its associated optimum and/or maximum parameter limits.

In the embodiment of FIG. 6, the tool library and other information concerning HDD machine function can be stored as program instructions in memory 603 executable by the processor 602 to control the functions of the thrust/pull back pump 608, rotation pump 609, and mud pump 610, among other components of an HDD machine. However, various other embodiments are not so limited, and could include multiple sets of memory and/or processors both on the rig and/or remote from the rig. For example, one unit of memory (e.g., a flash drive) may contain the tool library another unit of memory (e.g., a hard drive) may contain general operating instructions for operation of the boring machine, and the program instructions from each of the flash and hard drives may be executed by the same processor (e.g., processor 602) or two or more different processors to carryout the processes discussed herein.

The various processes illustrated and/or described herein (e.g., the processes of FIG. 4) can be performed using a single device embodiment (e.g., system of FIG. 1 with the circuitry of FIG. 6) configured to perform each of the processes, including display the information associated with FIGS. 2A-B and 3A-B on display screen 604.

The present disclosure provides a method of drilling that is more efficient and effective than prior drilling methods and minimizes the need for highly skilled specialists to be on hand to manage and program a boring rig. The operator according to this method does not need to rely as heavily on prior experience and/or training. In addition, the operator does not need to waste time referring to reference books while in the field. The machine provides default settings that provide acceptable tool performance for each of the available tools. On the other hand, the machine operator can manually set certain conditions to better adapt the tool to the particular application.

Moreover, the present disclosure provides a method of drilling that enables the operator to easily and efficiently collect operational data and machine feedback information from the job site. The operator can analyze the data and make adjustments in the field and/or can analyze the data at a later time to assess the performance of the machine or to better understand the physical conditions of the job site (e.g., soil type, rock hardness, etc.).

The above specification, examples and data provide a complete description of the manufacture and use of the composition of the invention. Since many embodiments of the invention can be made without departing from the spirit and scope of the invention, the invention resides in the claims hereinafter appended.

The discussion and illustrations provided herein are presented in an exemplary format, wherein selected embodiments are described and illustrated to present the various aspects of the present invention. Systems, devices, or methods according to the present invention may include one or more of the features, structures, methods, or combinations thereof described herein. For example, a device or system may be implemented to include one or more of the advantageous features and/or processes described below. A device or system according to the present invention may be implemented to include multiple features and/or aspects illustrated and/or discussed in separate examples and/or illustrations. It is intended that such a device or system need not include all of the features described herein, but may be implemented to include selected features that provide for useful structures, systems, and/or functionality.

Although only examples of certain functions may be described as being performed by circuitry for the sake of brevity, any of the functions, methods, and techniques can be performed using circuitry and methods described herein, as would be understood by one of ordinary skill in the art.

I claim:

1. A horizontal directional drilling (HDD) system having a tool library, comprising:

a horizontal directional drilling machine to which a drill string is attachable;

a plurality of tools configured to attach to a distal end of the drill string, each of the tools of the plurality configured for cutting soil in HDD;

a user interface having a display screen and a user input configured to output a user input signal; and a controller coupled to the user interface and the user input, the controller configured to receive the user input signal, store a plurality of operational tool profiles respectively associated with the plurality of tools, and selectively display one or more of the operational tool profiles on the display screen based on the user input signal, wherein each operational profile of the plurality contains operating parameters for the tool of the plurality with which the operational profile is associated.

2. The system of claim 1, wherein the operating parameters of each operational tool profile include operational boring parameter limits for the tool of the plurality with which the operational profile is associated.

3. The system of claim 2, wherein the operational boring parameter limits comprise one or more of a thrust limit, a rotational limit, a pressure limit, and a mud delivery limit.

4. The system of claim 1, wherein the operating parameters of each operational tool profile include information regarding one or more autodrill modes that the tool of the plurality with which the operational profile is associated is suited to execute.

5. The system of claim 1, further comprising:

a thrust pump configured to linearly advance the drill string based on a thrust control signal; and a rotation pump configured to rotate the drill string based on a rotation control signal, wherein:

the operating parameters of each operational tool profile include information regarding one or more automated drill modes that the tool of the plurality with which the operational profile is associated is suited to execute; and the controller is configured to automatically modulate the thrust control signal and the rotation control signal to operate the HDD system in accordance with the one or more automated drill modes based on selection, via the user input signal, of the operational profile associated with the one or more automated drill modes.

6. The system of claim 1, wherein the operating parameters of each operational tool profile include a graphic depiction of the tool of the plurality with which the operational profile is associated and the controller is configured to display the graphic on the display screen based on user selection of the operational tool profile, the user selection based on the input control signal.

7. The system of claim 1, wherein:

the controller is further configured to organize the plurality of operational tool profiles into multiple customized directories;

each customized directory of the multiple customized directories is user selectable based on the user input signal; and only those operational tool profiles organized into one or more of the customized directories that are selected are searchable while one or more of the customized directories are selected for searching based on the input control signal.

8. The system of claim 7, wherein each of the multiple customized directories correspond to a different job site and each of the operational tool profiles organized into each customized directory corresponds to one of a plurality of boring tools available at the respective job site.

9. The system of claim 1, wherein the controller is further configured to save boring data collected during boring operations, the boring data being indexed to the operational profile of the tool of the plurality attached to the drill string during boring operations as indicated by selection of the operational profile during boring operations, selection of the operational profile based on the input control signal, and wherein the controller is further configured to display the boring data when the operational profile to which the boring data is indexed is displayed on the display screen.

10. The system of claim 1, wherein at least one of the operational tool profiles of the plurality include a default setting and a customized setting, each of the default setting and the customized setting including information regarding operation of the boring tool with which the at least one operational profile is associated.

11. A method of organizing operational control parameters in horizontal directional drilling (HDD), comprising:

storing a plurality of operational tool profiles in memory, the operational tool profiles of the plurality respectively associated with a plurality of tools attachable to a drill string and configured for HDD, each of the operational tool profiles of the plurality including operating parameters for the tool of the plurality with which the operational profile is associated; and selectively displaying the operational tool profiles on a display screen based on a user input;

wherein the operating parameters of each operational tool profile include operational boring parameter limits for the tool of the plurality with which the operational profile is associated, and the operational boring parameter limits comprise one or more of a thrust limit, a rotational limit, a pressure limit, and a mud delivery limit.

12. The method of claim 11, wherein the operating parameters of each operational tool profile include information regarding one or more autodrill modes that the boring tool of the plurality with which the operational profile is associated is suited to execute.

13. The method of claim 11, further comprising:

selecting an operational profile of the plurality of operational profiles based on the user input, the selected operational profile including control instructions for an automated drill mode; and automatically controlling an output of a thrust pump that linearly advances the drill string and an output of a rotation pump that rotates the drill string using a control circuit in accordance with the automated drill mode of the selected operational tool profile.

14. The method of claim 11, further comprising:

organizing the plurality of operational tool profiles into multiple customized directories;

selecting one or more of the multiple customized directories based on user input; and searching amongst only those operational tool profiles that are organized into one or more of the customized directories that are selected.

15. The method of claim 14, wherein the multiple customized directories respectively correspond to a plurality of job sites and the operational tool profiles organized into the customized directories respectively correspond to boring tools available at the respective job sites.

16. The method of claim 11, further comprising:

boring at least a portion of a bore hole using a boring tool associated with a selected operational profile of the plurality of operational tool profiles;

collecting boring data while boring the portion of the bore hole;

saving the boring data in memory, the boring data indexed to the operational tool profile of the selected operational profile; and displaying the boring data on the display screen when the selected operational profile is displayed on the display screen.

17. A horizontal directional drilling (HDD) system having a tool library, comprising:

a plurality of tools configured to attach to a distal end of a drill string, each of the tools of the plurality configured for cutting soil in HDD;

a thrust pump configured to linearly advance the drill string;

a rotation pump configured to rotate the drill string;

means for storing a plurality of operational tool profiles in memory, the operational tool profiles of the plurality respectively associated with the plurality of tools, each of the operational tool profiles of the plurality including operating parameters for the tool of the plurality with which the operational profile is associated; and means for selectively displaying the operational tool profiles on a display screen based on a user input;

wherein the operating parameters of each operational tool profile include operational boring parameter limits for the tool of the plurality with which the operational profile is associated, and the operational boring parameter limits comprise one or more of a thrust limit, a rotational limit, a pressure limit, and a mud delivery limit.

18. The HDD system of claim 17, comprising:

means for organizing the plurality of operational tool profiles into multiple customized directories;

means for selecting one or more of the multiple customized directories based on user input; and means for searching amongst only those operational tool profiles that are organized into the one or more customized directories that are selected.

* * * * *